US010233579B2

(12) United States Patent
Chen

(10) Patent No.: US 10,233,579 B2
(45) Date of Patent: Mar. 19, 2019

(54) BLOWER FOR AIRFLOW DYEING MACHINE

(71) Applicant: Zhejiang Yinhe Printing & Dyeing Co., Ltd., Ningbo, Zhejiang Province (CN)

(72) Inventor: Hejun Chen, Ningbo (CN)

(73) Assignee: ZHEJIANG YINHE PRINTING & DYEING CO., LTD. (CN)

( * ) Notice: Subject to any disclaimer, the term of this patent is extended or adjusted under 35 U.S.C. 154(b) by 218 days.

(21) Appl. No.: 15/186,479

(22) Filed: Jun. 19, 2016

(65) Prior Publication Data

US 2017/0241056 A1 Aug. 24, 2017

(30) Foreign Application Priority Data

Feb. 19, 2016 (CN) ..... 2016 2 0129054 U

(51) Int. Cl.

*D06B 3/28* (2006.01)
*D06B 5/00* (2006.01)
*D06B 23/14* (2006.01)

(52) U.S. Cl.

CPC ..... *D06B 5/00* (2013.01); *D06B 3/28* (2013.01); *D06B 23/14* (2013.01); *D06B 2700/36* (2013.01)

(58) Field of Classification Search

CPC ..... D06F 5/00
See application file for complete search history.

(56) References Cited

U.S. PATENT DOCUMENTS

2003/0079505 A1* 5/2003 Chang ..... D06B 3/28 68/20
2007/0137562 A1* 6/2007 Cordes ..... D06B 3/28 118/325
2007/0283725 A1* 12/2007 Cordes ..... D06B 3/28 68/5 C

* cited by examiner

*Primary Examiner* — Jason Y Ko
(74) *Attorney, Agent, or Firm* — PROI Intellectual Property US

(57) ABSTRACT

A blower for an airflow dyeing machine is provided. Each four nozzles of the airflow dyeing machine shares a blower, the blower being disposed at a central position of the four nozzles; wherein the blower comprises: a motor, a blowing machine, a primary air duct, a secondary air duct, an air inlet and an air outlet, the motor driving the blowing machine to rotate, the blowing machine comprising a blowing machine housing and impellers, the impellers being disposed inside the blowing machine housing, two air outlets of the blowing machine being oppositely arranged and are disposed on two sides of the blowing machine housing which respectively supply air to the two nozzles at the two sides, the air inlet of the blowing machine being on a side opposing the motor, the two air outlets of the blowing machine being respectively coupled to one ends of the two primary air ducts.

6 Claims, 2 Drawing Sheets

BLOWER FOR AIRFLOW DYEING MACHINE

CROSS REFERENCE TO RELATED APPLICATIONS

The present application claims priority to Chinese Patent Application CN 2016 201 290 54.2 filed on Feb. 19, 2016.

TECHNICAL FIELD

The present invention relates to an airflow dyeing machine, and in particular, relates to a blower for an airflow dyeing machine.

BACKGROUND

An airflow dyeing machine is mainly used for pre-processing and dyeing the blank cloth, and mainly comprises a cylinder block 2, a cloth storage tank 3, a cloth guide wheel 1, nozzles 14, a heat exchanger 5, a filter screen 4, a primary pump 6, a blowing machine 8, a material feed system and the like. During the pre-processing or dyeing of the blank cloth, the blowing machine and the primary pump supply atomized airflow to the nozzles which feeds the blank cloth to the cloth storage tank inside the cylinder block, and the blank cloth with its head coupling to its tail is subjected to cyclic rope-like operation in the dyeing machine. A conventional airflow dyeing machine typically has two to twenty-two pipelines, each having a nozzle. For saving power, an independent vertical blowing machine is provided for each nozzle. However, in such a power saving solution, the machine causes greater vibrations, and has low power efficiency. In addition, the pipelines may also be subjected to dyeing color difference and the like problems, and the machine is high in cost.

SUMMARY

With respect to the problem existent in the related art, the present invention is intended to provide a technical solution of a blower for an airflow dyeing machine.

A blower for an airflow dyeing machine is provided, each four nozzles of the airflow dyeing machine sharing a blower, the blower being disposed at a central position of the four nozzles; wherein the blower comprises: a motor, a blowing machine, a primary air duct, a secondary air duct, an air inlet and an air outlet, the motor driving the blowing machine to rotate, the blowing machine comprising a blowing machine housing and impellers, the impellers being disposed inside the blowing machine housing, two air outlets of the blowing machine being oppositely arranged and are disposed on two sides of the blowing machine housing which respectively supply air to the two nozzles at the two sides, the air inlet of the blowing machine being on a side opposing the motor, the two air outlets of the blowing machine being respectively coupled to one ends of the two primary air ducts, and the other ends of the two primary air ducts being respectively coupled to nozzle air inlets of the two nozzles via the two secondary air ducts.

In the blower for an airflow dyeing machine, the blower is disposed in an interior or at an upper portion of a cylinder block and is vertically arranged.

In the blower for an airflow dyeing machine, two primary air ducts are used which have the same dimension.

In the blower for an airflow dyeing machine, four secondary air ducts are used which have the same dimension.

In the blower for an airflow dyeing machine, the motor is disposed at an upper portion of the blowing machine housing, the impellers are coupled to an output shaft of the motor and are disposed inside the blowing machine housing, and the air inlet is disposed at a lower portion of the blowing machine housing.

In the blower for an airflow dyeing machine, a shaft connection mechanical seal is disposed at a joint of an output shaft of the motor and the blowing machine housing.

According to the present invention, four nozzles of the airflow dyeing machine share the same blower, the blower is disposed at a central position of the four nozzles, and the blower uniformly supplies desired air amount to the four nozzles via two oppositely and symmetrically arranged air outlets respectively through two primary air ducts to four secondary air ducts respectively.

When the airflow dyeing machine equipped with the blower according to the present invention runs, the motor starts running, the airflow generated by the blowing machine flows through the primary air ducts and the secondary air ducts and is finally uniformly supplied to the four nozzles driving the cloth blank to operate. In this way, in one aspect, the investment cost may be lowered, the operation is normal and power is saved; and in another aspect, the dyeing quality may be improved.

Figure 1:
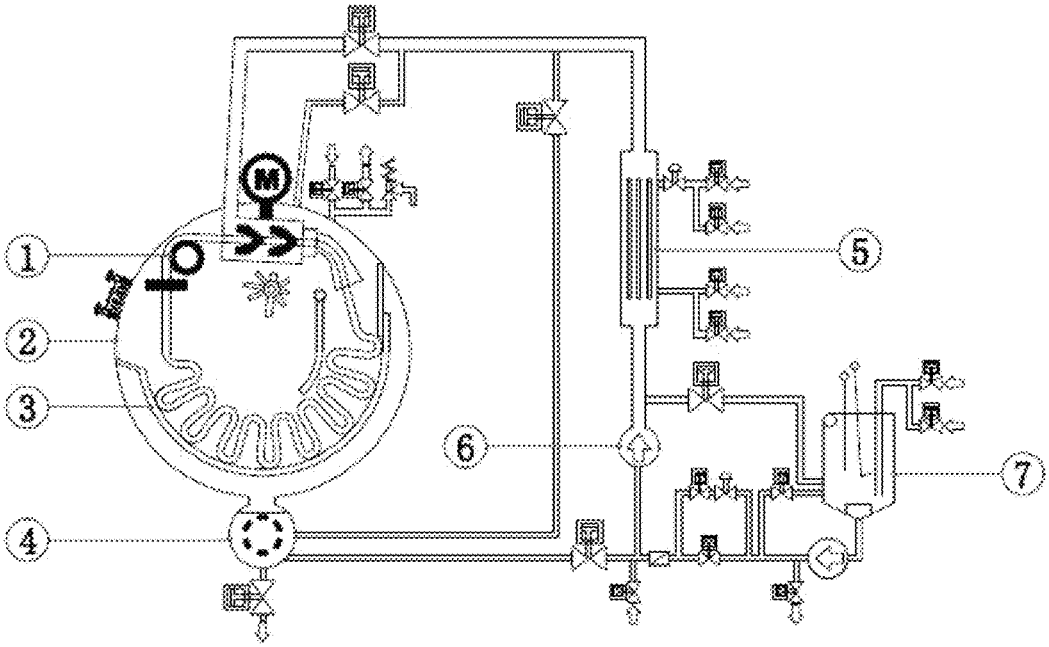
FIG. 1 is a schematic structural view of a airflow dyeing machine according to the present invention.
Figure 2:
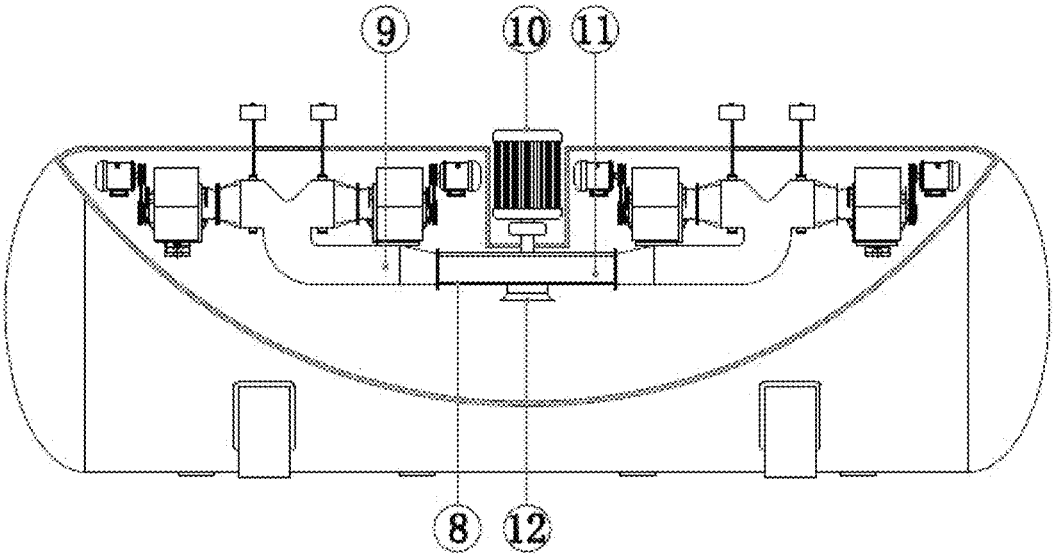
FIG. 2 is a first schematic structural view of a blower according to the present invention.
Figure 3:
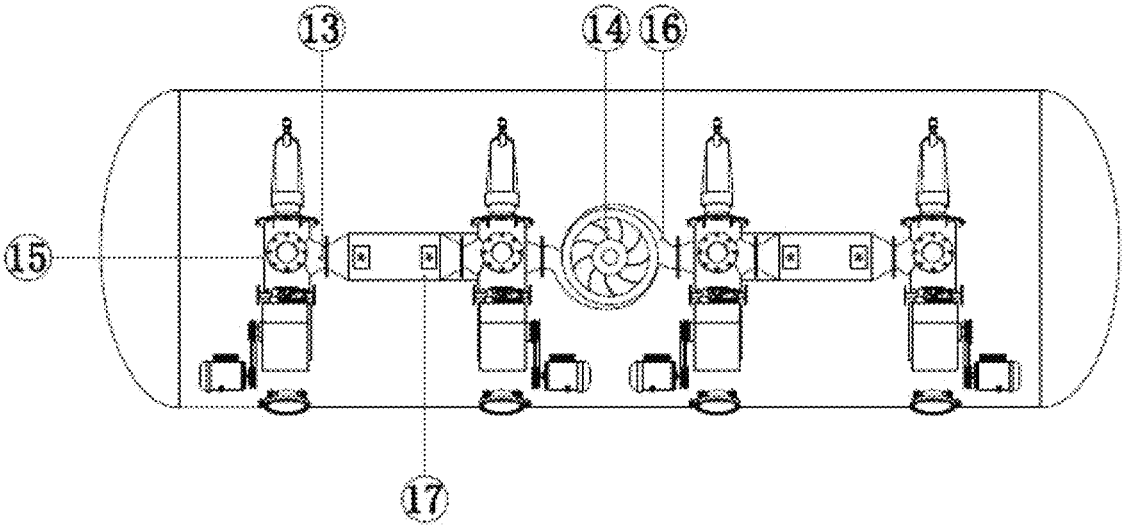
FIG. 3 is a second schematic structural view of a blower according to the present invention.

Reference numerals and denotations thereof:

1-cloth guide wheel, 2-cylinder block, 3-cloth storage tank, 4-filter screen, 5-heat exchanger, 6-primary pump, 7-material feed system, 8-blowing machine, 9-primary air duct, 10-motor, 11-air outlet, 12-air inlet, 13-nozzle air inlet, 14-impeller, 15-nozzle, 16-blowing machine housing, 17-secondary air duct.

DETAILED DESCRIPTION

The present invention is further described hereinafter with reference to the accompanying drawings.

An airflow dyeing machine is generally provided with two to twenty-four pipelines, wherein each pipeline is provided with a nozzle which needs an air inlet. In the airflow dyeing machine according to the present invention, each four nozzles share a blower. The blower is disposed in an interior or at an upper portion of a cylinder block, and is vertically arranged; and the blower is disposed at a central position of the four nozzles. The blower comprises a motor 10, a blowing machine 8, primary air ducts 9, secondary air ducts 17, an air inlet 12 and air outlets 11. The motor 10 drives the blowing machine 8 to rotate. The blowing machine 8 comprises a blowing machine housing 16 and impellers 14, wherein the impellers 14 are disposed inside the blowing machine housing 16, two air outlets 11 of the blowing machine are oppositely arranged and are disposed on two sides of the blowing machine housing 16 which respectively supply air to the two nozzles 15 at the two sides, and the air inlet of the blowing machine is disposed on a side opposing the motor; the two air outlets of the blowing machine are respectively coupled to one ends of the two primary air ducts 9, and the other ends of the two primary air ducts 9 are respectively coupled to the nozzle air inlets 13 of the two nozzles 15 via the two secondary air ducts 17.

There is only one air inlet, and there are two air outlets which are disposed on two sides of the blowing machine. There are two primary air ducts which have the same dimension, ensuring that the four air ports supply a constant air amount to the nozzles and that the efficiency of the blowing machine is maximized. The two air outlets are each provided with a primary air duct, wherein each primary air duct is provided with two secondary air ducts which are respectively coupled to the nozzles. There are four secondary air ducts which have the same dimension. When the airflow dyeing machine runs, the motor starts running, the airflow generated by the blowing machine flows through the primary air ducts and the secondary air ducts and is finally uniformly supplied to the four nozzles driving the blank cloth to operate, for pre-processing and dyeing. In this way, in one aspect, the investment cost may be lowered, power is saved and vibrations are reduced; and in another aspect, the dyeing quality may be improved.

The motor is disposed at an upper portion of the blowing machine housing, the impellers are coupled to an output shaft of the motor and are disposed inside the blowing machine housing, the air inlet is disposed at a lower portion of the blowing machine housing, the two air outlets are respectively disposed on two sides of the blowing machine which are respectively coupled to the two primary air ducts, and a shaft connection mechanical seal is disposed at a joint of an output shaft of the motor and the blowing machine housing.

Using the airflow dyeing machine with four pipelines as an example, a blower is arranged, and the airflow generated by the blower is respectively uniformly supplied to the four nozzles, such that the blank cloth operates within the cylinder block. In addition, an atomization effect is achieved to the liquid flow, thereby implementing pre-processing or dyeing.

Optionally, eight pipelines use two sets of blowers, and 24 pipelines use six sets of blowers.

Optionally, one blower may be disposed for two pipelines, six pipelines or eight pipelines.

Optionally, the blower may be disposed inside the cylinder block or outside the cylinder block.

The blower for an airflow dyeing machine according to the present invention achieves the effects of high efficiency, saving power, reducing vibrations, reducing space and lowering manufacture cost, and in addition satisfies the requirement of a large capacity blower for an airflow dyeing machine.

What is claimed is:

1. A blower for an airflow dyeing machine, wherein four nozzles of the airflow dyeing machine share the same blower, the blower being disposed at a central position of the four nozzles; wherein the blower comprises: a motor, a blowing machine, a primary air duct, a secondary air duct, an air inlet and an air outlet, the motor driving the blowing machine to rotate, the blowing machine comprising a blowing machine housing and impellers, the impellers being disposed inside the blowing machine housing, two air outlets of the blowing machine being oppositely arranged and are disposed on two sides of the blowing machine housing which respectively supply air to the two nozzles at the two sides, the air inlet of the blowing machine being on a side opposing the motor, the two air outlets of the blowing machine being respectively coupled to one ends of the two primary air ducts, and the other ends of the two primary air ducts being respectively coupled to nozzle air inlets of the two nozzles via the two secondary air ducts.

2. The blower for an airflow dyeing machine according to claim 1, wherein the blower is disposed in an interior or at an upper portion of a cylinder block and is vertically arranged.

3. The blower for an airflow dyeing machine according to claim 1, wherein two primary air ducts are used which have the same dimension.

4. The blower for an airflow dyeing machine according to claim 1, wherein four secondary air ducts are used which have the same dimension.

5. The blower for an airflow dyeing machine according to claim 1, wherein the motor is disposed at an upper portion of the blowing machine housing, the impellers are coupled to an output shaft of the motor and are disposed inside the blowing machine housing, and the air inlet is disposed at a lower portion of the blowing machine housing.

6. The blower for an airflow dyeing machine according to claim 1, wherein a shaft connection mechanical seal is disposed at a joint of an output shaft of the motor and the blowing machine housing.

* * * * *